US010822886B2

(12) United States Patent
Dallas et al.

(10) Patent No.: US 10,822,886 B2
(45) Date of Patent: Nov. 3, 2020

(54) MECHANICALLY PERFORATED WELL CASING COLLAR

(71) Applicant: Exacta-Frac Energy Services, Inc., Conroe, TX (US)

(72) Inventors: Lloyd Murray Dallas, Streetman, TX (US); Joze John Hrupp, Montgomery, TX (US)

(73) Assignee: Exacta-Frac Energy Services, Inc., Conroe, TX (US)

( * ) Notice: Subject to any disclaimer, the term of this patent is extended or adjusted under 35 U.S.C. 154(b) by 156 days.

(21) Appl. No.: 16/149,301

(22) Filed: Oct. 2, 2018

(65) Prior Publication Data

US 2020/0102794 A1 Apr. 2, 2020

(51) Int. Cl.
*E21B 17/08* (2006.01)
*E21B 43/119* (2006.01)
*E21B 17/042* (2006.01)

(52) U.S. Cl.
CPC ..... *E21B 17/08* (2013.01); *E21B 43/119* (2013.01); *E21B 17/042* (2013.01)

(58) Field of Classification Search
CPC ..... E21B 17/08; E21B 43/119; E21B 23/01; E21B 23/02; E21B 23/03
USPC ..... 166/242.1
See application file for complete search history.

(56) References Cited

U.S. PATENT DOCUMENTS 1,433,722 A * 10/1922 Hinderliter ..... E21B 29/00 166/55.2
1,731,553 A * 10/1929 Godefridus ..... E21B 29/00 166/55.2
1,776,025 A * 9/1930 Hinderliter ..... E21B 29/00 166/55.2
1,896,104 A * 2/1933 Simmons ..... E21B 17/08 166/287
2,160,357 A * 5/1939 Hammer ..... E21B 33/12 166/136
2,322,695 A * 6/1943 Kinzbach ..... B23B 5/162 166/55.8
2,537,284 A * 1/1951 Schuder ..... E21B 17/08 285/319
2,705,998 A * 4/1955 Spang ..... E21B 29/00 166/55.3
2,741,316 A * 4/1956 Long ..... E21B 47/09 166/63

(Continued)

FOREIGN PATENT DOCUMENTS

CA 2842568 A1 * 5/2014 ..... E21B 31/00
CA 2924345 A1 * 5/2015 ..... E21B 23/002

(Continued)

OTHER PUBLICATIONS

American Petroleum Institute Bulletin 5C3, Fifth Edition, Jul. 1989. Bulleting on Formulas and Calculations for Casing, Tubing, Drill Pipe and Line Pipe Properties. pp. 16 and 17.

*Primary Examiner* — Jennifer H Gay
(74) *Attorney, Agent, or Firm* — Bennett Mullinax, LLC

(57) ABSTRACT

A mechanically perforated well casing collar has at least one machined-away area on a sidewall surface to facilitate mechanical perforation of the casing collar, and an internal guide and lock structure to guide at least one blade of a mechanical perforator into alignment with the at least one machined-away area and permit the mechanical perforator to lock in that alignment.

15 Claims, 8 Drawing Sheets

(56) References Cited

U.S. PATENT DOCUMENTS 2,746,550 A * 5/1956 Mitchell, Jr. ..... E21B 19/00 166/255.1
2,753,935 A * 7/1956 Fredd ..... E21B 43/112 166/55.2
2,859,826 A * 11/1958 Eckel ..... E21B 33/14 166/136
2,999,542 A * 9/1961 Myers ..... E21B 47/09 166/64
3,037,797 A * 6/1962 Brown ..... E21B 43/14 285/18
3,105,556 A * 10/1963 Raulins ..... E21B 23/02 166/214
3,322,199 A 5/1967 Van Note
3,344,862 A * 10/1967 Conrad ..... E21B 29/00 166/216
3,366,179 A * 1/1968 Kinley ..... E21B 43/11855 166/55.3
3,367,002 A * 2/1968 Johnson ..... E21B 33/04 175/423
3,447,604 A * 6/1969 Anderson ..... E21B 43/11855 166/63
3,468,386 A * 9/1969 Johnson ..... E21B 43/117 175/4.6
4,165,784 A * 8/1979 Gardner ..... E21B 43/112 166/117.5
4,317,023 A 2/1982 Gryskiewicz
4,513,817 A * 4/1985 Weinberg ..... E21B 17/06 166/138
5,348,087 A * 9/1994 Williamson, Jr. ..... E21B 23/02 166/115
5,390,735 A * 2/1995 Williamson, Jr. ..... E21B 23/02 166/115
5,579,829 A * 12/1996 Comeau ..... E21B 23/02 166/117.6
6,009,947 A 1/2000 Wilson et al.
6,202,746 B1 * 3/2001 Vandenberg ..... E21B 7/061 166/117.6
6,543,539 B1 4/2003 Vinegar et al.
6,755,249 B2 6/2004 Robinson et al.
6,913,082 B2 * 7/2005 McGlothen ..... E21B 41/0035 166/313
7,490,676 B2 * 2/2009 Nobileau ..... E21B 17/08 166/292
7,520,335 B2 4/2009 Richard et al.
7,581,591 B2 * 9/2009 Schwindt ..... B23D 11/00 166/298
7,789,163 B2 9/2010 Kratochvil et al.
8,739,879 B2 6/2014 King
8,863,850 B2 10/2014 Sherman et al.
8,944,167 B2 2/2015 Ravensbergen et al.
9,121,266 B2 9/2015 Sherman
10,337,271 B2 * 7/2019 Robertson ..... E21B 29/00
2002/0144815 A1 * 10/2002 Van Drentham-Susman ..... E21B 23/04 166/241.1
2004/0040707 A1 3/2004 Dusterhoft et al.
2006/0254778 A1 * 11/2006 Nobileau ..... E21B 33/14 166/380
2008/0178721 A1 * 7/2008 Schwindt ..... E21B 43/112 83/191
2009/0014174 A1 1/2009 Hollies
2009/0321076 A1 12/2009 Wiley et al.
2012/0160516 A1 * 6/2012 Ravensbergen .... E21B 47/0905 166/380
2015/0101812 A1 * 4/2015 Bansal ..... E21B 29/002 166/298
2015/0300135 A1 * 10/2015 Micak ..... E21B 43/119 166/298
2016/0010408 A1 * 1/2016 Stokes ..... E21B 23/002 166/381
2016/0138369 A1 * 5/2016 Tunget ..... E21B 29/00 166/311
2016/0160620 A1 * 6/2016 Al-Gouhi ..... E21B 43/117 166/297
2016/0265294 A1 * 9/2016 Robertson ..... E21B 23/02
2016/0273293 A1 * 9/2016 Surjaatmadja ..... E21B 33/13
2018/0038221 A1 * 2/2018 Hughes ..... E21B 33/124
2018/0156000 A1 * 6/2018 Cleven ..... E21B 23/02
2018/0334881 A1 * 11/2018 Dallas ..... E21B 17/006
2019/0186224 A1 * 6/2019 Beazer ..... E21B 34/10
2019/0257177 A1 * 8/2019 Greci ..... E21B 29/005
2019/0323310 A1 * 10/2019 Robertson ..... E21B 23/01
2020/0102794 A1 * 4/2020 Dallas ..... E21B 17/006
2020/0102815 A1 * 4/2020 Hrupp ..... E21B 43/119
2020/0109613 A1 * 4/2020 Hrupp ..... E21B 23/01

FOREIGN PATENT DOCUMENTS

WO WO-0229207 A1 * 4/2002 ..... E21B 33/14
WO WO-2015073011 A1 * 5/2015 ..... E21B 43/112

* cited by examiner

MECHANICALLY PERFORATED WELL CASING COLLAR

CROSS REFERENCE TO RELATED APPLICATIONS

This is the first application for this invention.

FIELD OF THE INVENTION

This invention relates in general to well casing systems and, in particular, to a novel mechanically perforated casing collar for use in well casing systems used to complete hydrocarbon wells.

BACKGROUND OF THE INVENTION

Well casing systems are well known in the art and are used assemble a "casing string" that is inserted to a hydrocarbon well bore to provide a smooth liner in the well bore. Casing strings are typically assembled using lengths of plain pipe having pin-threaded ends called "casing joints", which are interconnected using short tubular "casing collars" that have complimentarily box-threaded ends, but the casing joints may have box-threaded ends and the casing collars may have pin-threaded ends. The casing string is generally "cemented in" after it is run into a completed well bore by pumping liquid cement down through and up around the outside of the casing string. The cement sets and inhibits fluid migration within the wellbore behind the casing. As is well understood in the art, once a casing string is cemented in the well bore, it provides a fluid-tight passage from the wellhead to a "toe" or bottom of the well. Consequently, the casing must be perforated within the production zone(s) of the well bore to permit hydrocarbon to flow into the casing string for production to the surface.

Numerous methods of perforating casing in order to complete hydrocarbon wells have been invented. The most widely adopted method currently in use involves the use of perforating "guns". Perforating guns shoot projectiles through the casing and surrounding cement using explosive charges. While perforating guns are reliable and effective, each set of perforating guns must be run into the well. Consequently, well completion of long lateral well bores requires many sequential trips into and out of the well bore, and hydraulic fracturing equipment sits idle during each trip. To obviate these delays, sliding sleeve casing systems having sliding sleeve valves opened by size-graduated, pumped-down balls were invented so well completion fracturing could progress in a virtually uninterrupted process. A sliding sleeve casing string is assembled and run into an open bore hole and is generally not cemented in place. Rather, packers placed at intervals around the sliding sleeve casing string are used to inhibit fluid migration beyond zones isolated by the respective packers. However, only a predetermined number of sliding sleeve valves may be distributed within the sliding sleeve casing string because of the size graduation limits on the pumped-down balls so the length of a wellbore that can be completed using sliding sleeve valves is limited. Furthermore, sliding sleeve valves are vulnerable to reliability issues.

Consequently, pressure perforated well casing joints and pressure perforated well casing collars were invented for use in shallow wells where wellbore pressures are relatively moderate and consistent. Pressure perforated well casing systems can be used in a lateral well bore of any length and provides much more flexibility in terms of perforation placement than the sliding sleeve casing systems. However, current drilling and well completion equipment and completion techniques permit hydrocarbon wells to be drilled much deeper, where subterranean fluid pressures are significantly higher, and also permit lateral wells to be drilled to lengths of more than 10,000 feet (3000 meters) in the lateral segment. In such long lateral well bores, well bore pressure may be inconsistent and unpredictable and cement infiltration around the casing string may be uneven. High downhole fluid pressures may elevate the fluid pressure required to perforate casing beyond a pressure limit of pumping equipment, and unpredictable fluid pressures and/or uneven cement infiltration around a casing string in the wellbore significantly complicate pressure perforation because perforation pressure cannot be accurately predicted.

A mechanical casing perforator obviates any issues associated with high downhole fluid pressures, unpredictable downhole fluid pressures or uneven cement penetration. Mechanical casing perforators are known, though they have never gained widespread use. Punching through standard casing requires considerable force. Consequently, the known mechanical perforators not only tend to deform the internal diameter of the standard casing, they also have a limited duty cycle.

There therefore exists a need for a mechanically perforated well casing collar that facilitates reliable mechanical casing perforation regardless of well bore length, well bore depth or ambient downhole fluid pressure and facilitates uninterrupted well completion in a lateral wellbore of any length that can be drilled and cased.

SUMMARY OF THE INVENTION

It is therefore an object of the invention to provide a mechanically perforated well casing collar that overcomes the shortcomings of the prior art.

The invention therefore provides a mechanically perforated well casing collar comprising a tubular pipe having a sidewall with at least one machined-away area that facilitates mechanical perforation of the sidewall, the sidewall further having an inner surface with a guide and lock structure that guides a mechanical perforator into a position in which at least one perforator blade of the mechanical perforator is aligned with respective ones of the at least one machined-away area and further provides structure to permit the mechanical perforator to lock within the casing collar when the at least one perforator blade in is alignment with the respective ones of the at least one machined-away area of the sidewall.

The invention further provides a mechanically perforated well casing collar comprising a tubular body having a sidewall with at least three spaced-apart machined-away areas that respectively facilitate mechanical perforation of the sidewall, and an inner surface with a guide and lock structure that guides a mechanical perforator having at least three perforator blades into a position in which the at least three perforator blades are in alignment with the respective machined-away areas, and further provides structure to permit the mechanical perforator to be locked in the position in which the respective perforator blades are in alignment with the respective machined-away areas of the sidewall.

The invention yet further provides a mechanically perforated well casing collar comprising a sidewall with an inner surface having a guide structure that guides a mechanical perforator having at least one perforator blade into a position within the well casing collar in which the at least one perforator blade is aligned with a machined-away area on the sidewall that facilitates mechanical perforation of the sidewall by the at least one perforator blade, sidewall material at the at least one machined-away area having a predetermined yield strength.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

Figure 1:
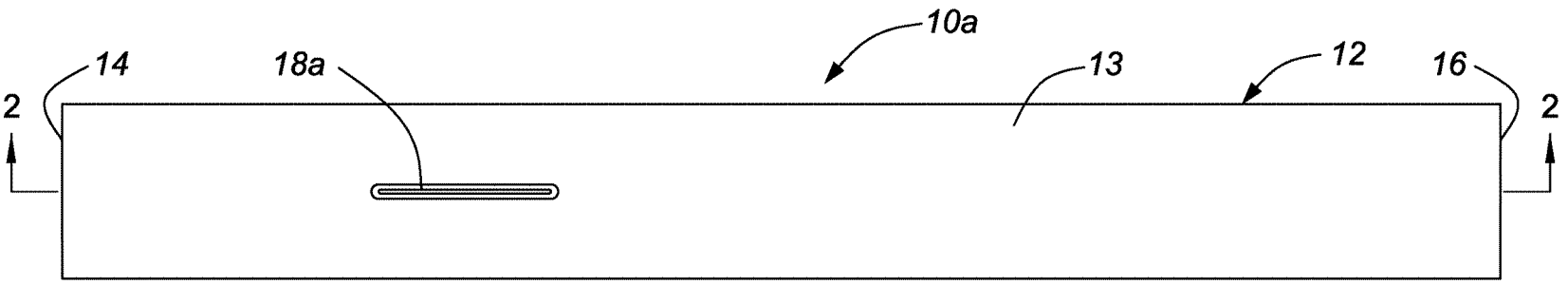
FIG. 1 is a side elevational view of one embodiment of a mechanically perforated well casing collar in accordance with the invention.

The invention provides a mechanically perforated well casing collar used to interconnect "plain casing joints" to assemble a casing string to case a drilled well bore. Plain casing joints are any commercially available casing joint having an unperforated sidewall, of any desired weight and any desired length. Plain casing collars may also be used in conjunction with the mechanically perforated casing collars in accordance with the invention to assemble the casing string. Casing string configuration is a matter of design choice understood by those skilled in the art and dependent, at least in part, on formation characteristics. The mechanically perforated casing collar is a tubular pipe having at least one machined-away area(s) of the casing collar sidewall to facilitate mechanical perforation, and an internal guide and lock structure on an inner surface of the sidewall to guide a mechanical perforator blade(s) into alignment with the machined-away area(s) and lock the mechanical perforator in the location for perforating the casing collar at the machined-away area(s). The machined-away area(s) weakens the sidewall to an extent adequate to facilitate and control mechanical perforation, while leaving enough sidewall material to ensure that the casing collar cannot be pressure perforated by cementing or fracturing operations required to complete the well. This permits fracturing fluid to be pumped down an annulus of the cased well during well completion, which significantly improves well fracturing efficiency and reduces overall well completion time. The machined-away area(s) also ensures that the casing collar is reliably perforated with minimal distortion of the casing collar sidewall, and that the perforation(s) have a consistent initial size and shape so fracturing fluid evenly distributes among the respective perforation(s) in the casing collar.

As used in this application mechanical perforator "blade" means any instrument that can be pushed against a weakened area of the sidewall of the casing collar to effect perforation without undue distortion of the sidewall of the casing collar. The blade need not have a sharp edge, and the edge may include wear resistant buttons of diamond or carbide to control blade wear.

PARTS LIST

| Part No. | Part Description |
|---|---|
| 10a-10d | Casing collar (first, second, third and fourth embodiments) |
| 12 | Sidewall |
| 13 | Sidewall outer surface |
| 14 | Uphole end |
| 16 | Downhole end |
| 18a-18o | Machined-away areas |
| 20 | Sidewall inner surface |
| 22 | Guide and lock structure |
| 24, 24d | Guide recess uphole edge |
| 26a-c | Guide points |
| 28a-28c | Guide funnels |
| 29a-29f | Guide funnel end ramps |
| 30a-30c | Skate lock recesses |
| 31a-31c | Skate lock recess uphole edges |
| 32 | Sidewall material |
| 34 | Box thread |
| 34d | Pin thread |
| 40 | Casing collar (fifth embodiment) |
| 42 | Sidewall |
| 43 | Sidewall outer surface |
| 44 | Uphole end |
| 46 | Downhole end |
| 48a-48d | Machined-away areas |
| 50 | Sidewall inner surface |
| 52 | Guide and lock structure |
| 54 | Guide recess uphole edge |
| 56a-56d | Guide points |
| 58a-58d | Guide funnels |
| 59a-59c | Guide funnel end ramps |
| 60a-60d | Skate lock recesses |

-continued

| Part No. | Part Description |
|---|---|
| 62 | Sidewall material |
| 64 | Box thread |
| 100 | Mechanical perforator |
| 102a, 102c | Perforator blades |
| 104a, 104c | Guide skates |
| 106 | Linear force generator |
| 108 | Downhole tool termination components |
| 110 | Central passage of mechanical perforator |

FIG. 1 is a side elevational view of one embodiment of a mechanically perforated casing collar 10*a* in accordance with the invention. The casing collar 10*a* is a tubular pipe having a sidewall 12 with an outer surface 13, an uphole end 14 and a downhole end 16. In one embodiment, the outer surface 13 is provided with at least one machined-away area 18*a* to facilitate mechanical perforation of the casing collar 10*a* and reduce distortion of the sidewall 12 when the casing collar 10*a* is mechanically perforated. A size and shape of the machined-away area 18*a* is a matter of design choice, within constraints well understood by those skilled in the art of mechanical casing perforation. In this embodiment the machined-away area 18*a* is a straight slot, which is rapidly and efficiently cut using a milling machine, a metal lathe or a combination milling machine/lathe, in a manner well known in the art.

Figure 2:
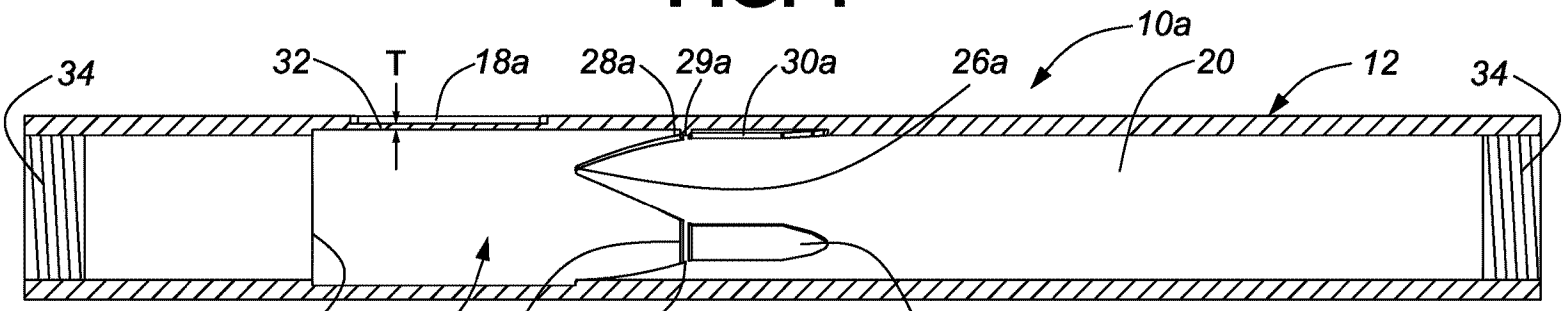
FIG. 2 is a cross-sectional view taken along lines 2-2 of the mechanically perforated well casing collar shown in FIG. 1.

FIG. 2 is a cross-sectional view taken along lines 2-2 of the mechanically perforated well casing collar 10*a* shown in FIG. 1. The machined-away area 18*a* is cut to a consistent depth, leaving sidewall material 32 having a thickness "T" in a bottom of the groove. The thickness "T" is dependent a metallurgy of the casing collar 10*a* (which determines the sidewall material 32 yield strength), and a planned maximum fluid pressure to be used during hydraulic fracturing operations to complete a well cased with a casing string assembled using the casing collar 10*a*. The thickness "T" of remaining sidewall material 32 must have a minimal predetermined yield strength that exceeds the planned maximum fracturing fluid pressure to be used to complete the well. This permits fracturing fluid to be pumped down an annulus of the casing string without risk that any of the machined-away areas 18*a*-18*c* that facilitate mechanical perforation of the casing collar 10*a* will be ruptured by the frac fluid pressure.

The casing collar 10*a* further includes an inner surface 20, which is provided with a guide and lock structure 22 to guide perforating blade(s) of a mechanical perforator 100 (see FIGS. 13-15) into alignment with the machined-away area(s) 18*a*. The configuration of the guide and lock structure 22 is a matter of design choice dependent on a configuration of the mechanical perforator used to mechanically perforate the casing collar 10*a*. In one embodiment, the guide and lock structure 22 is an annular machined-away area in the inner surface 20. In this embodiment, the guide and lock structure 22 has a guide recess uphole edge 24, which is an annular step in the inner surface 20 of the sidewall 12. The guide and lock structure 22 further includes guide funnels 28*a*-28*c*, which respectively urge "guide skates" of a mechanical perforator into respective skate lock recesses 30*a*-30*c* of the guide and lock structure 22. In one embodiment, the casing collar 10 has three machined-away areas 18*a*-18*c*, as best seen in x-ray view in FIG. 3, and three guide funnels 28*a*-28*c*. Between each guide funnel 28*a*-28*c* is a guide point 26*a*-26*c*. The guide points 26*a*-26*c* respectively deflect the guide skates of the mechanical perforator 100 into one of the respective guide funnels 28*a*-28*c*, if they happen to be out of alignment with the respective guide funnels 28*a*-28*c* as the mechanical perforator 100 is pushed downhole in the casing string, as will be explained below in more detail with reference to FIGS. 16-18. Box threads 34 on each end of the well casing collar 10*a* permit the connection of respective plain casing joints (not shown) having mating pin threads, in a manner well known in the art.

Figure 3:
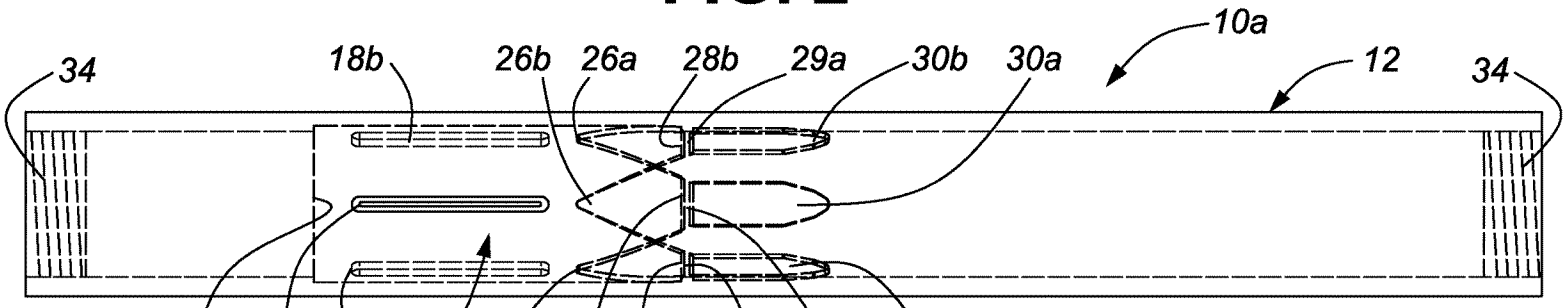
FIG. 3 is an x-ray view of the mechanically perforated well casing collar shown in FIG. 1.

FIG. 3 is an x-ray view of the mechanically perforated well casing collar 10*a* shown in FIG. 1. As explained above, the well casing collar 10*a* is configured for use with a mechanical perforator having three guide skates and three perforator blades. As explained above, in this embodiment the guide and lock structure 22 therefore includes three guide points 26*a*, 26*b* and 26*c*, which respectively deflect three guide skates of the mechanical perforators into respective guide funnels 28*a*, 28*b* and 28*c* as the mechanical perforator 100 is pushed into the casing string. As the mechanical perforator 100 is pushed further into the casing string, the guide skates are urged along one side of the respective guide funnels 28*a*, 28*b* and 28*c* and into a bottom of each guide funnel 28*a*-28*c*, which aligns the guide skates with the respective skate lock recesses 30*a*, 30*b* and 30*c*. Guide funnel end ramps 29*a*, 29*b* and 29*c* urge the respective guide skates to glide up out of the respective guide funnels 28*a*-28*c*. As the respective guide skates are urged out of each guide funnel 28*a*-28*c*, the guide skates respectively drop into a skate lock recess 30*a*, 30*b* or 30*c*, which are respectively in direct alignment with the corresponding guide funnels 28*a*, 28*b* and 28*c*. The respective skate lock recesses 30*a*, 30*b* and 30*c* have square-stepped downhole ends that inhibit further downhole movement of the mechanical perforator 100, to lock the perforator blades in alignment with the respective machined-away areas 18*a*, 18*b* and 18*c*. This perforator blade alignment process will be described below in more detail with reference to FIGS. 16-18.

Figure 4:
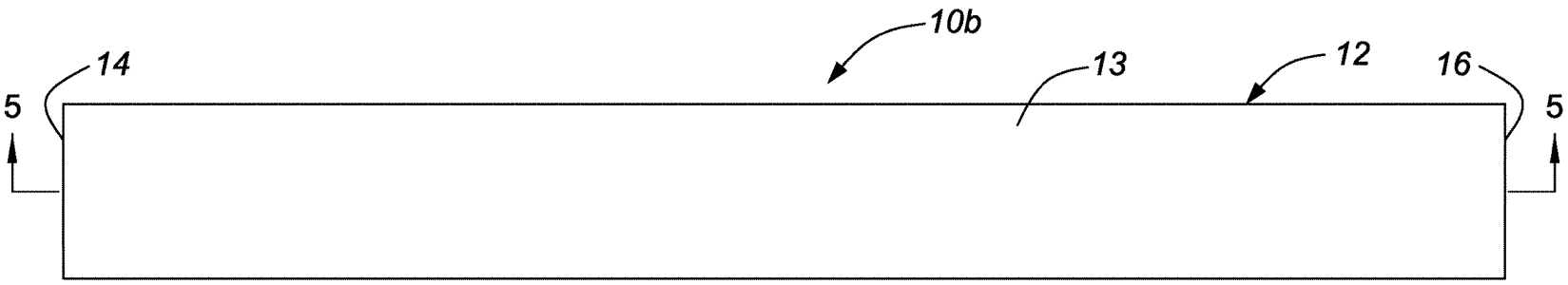
FIG. 4 is a side elevational view of another embodiment of a mechanically perforated well casing collar in accordance with the invention.

FIG. 4 is a side elevational view of another embodiment 10*b* of a mechanically perforated well casing collar in accordance with the invention. The well casing collar 10*b* is identical to the well casing collar 10*a* described above with reference to FIGS. 1-3, except that machined away areas 18*d*, 18*e* and 18*f* (see FIG. 6) are machined within the guide and lock structure 22 of the casing collar 10*b*.

Figure 5:
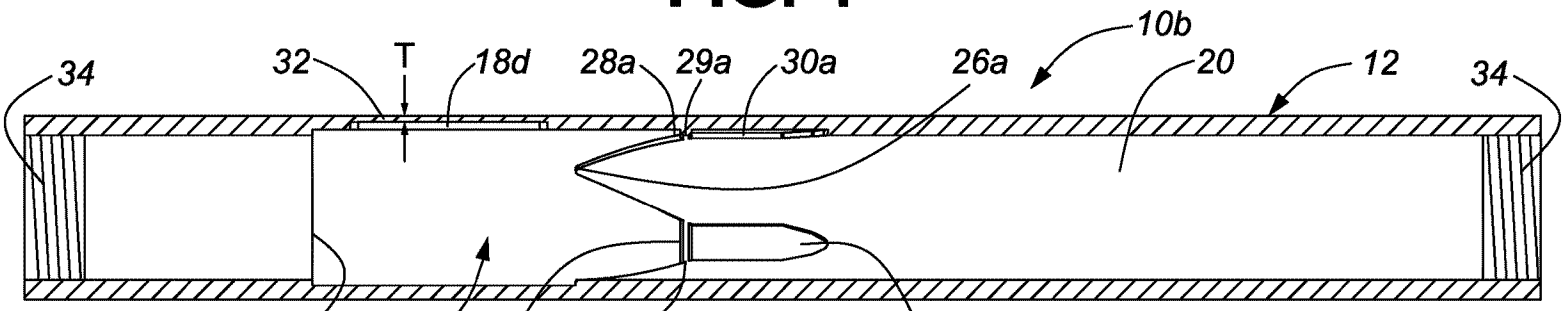
FIG. 5 is a cross-sectional view taken along lines 5-5 of the mechanically perforated well casing collar shown in FIG. 4.
Figure 6:
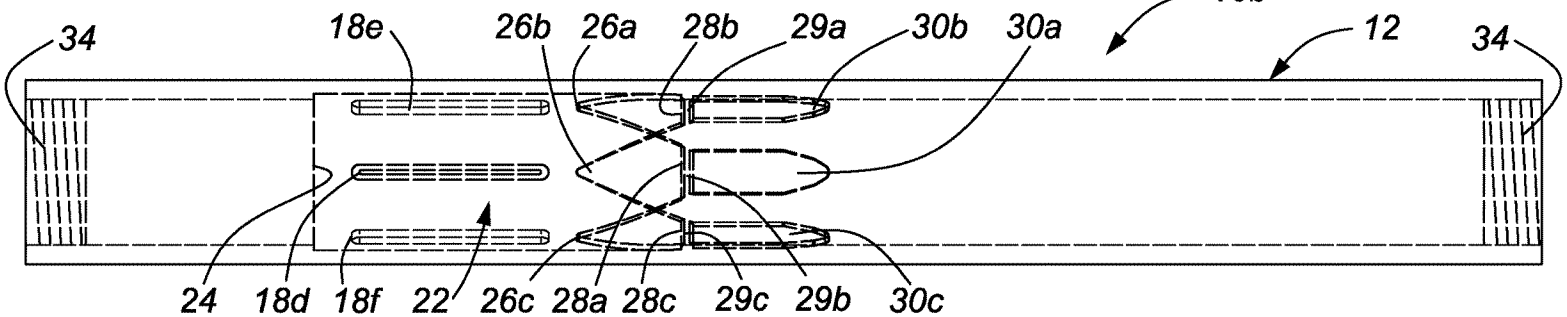
FIG. 6 is an x-ray view of the mechanically perforated well casing collar shown in FIG. 4.

FIG. 5 is a cross-sectional view taken along lines 5-5 of the mechanically perforated well casing collar 10*b* shown in FIG. 4, and FIG. 6 is an x-ray view of the mechanically perforated well casing collar 10*b* shown in FIG. 4. The remaining structure of the casing collar 10*b* described above with reference to FIGS. 1-3 will not be repeated.

Figure 7:
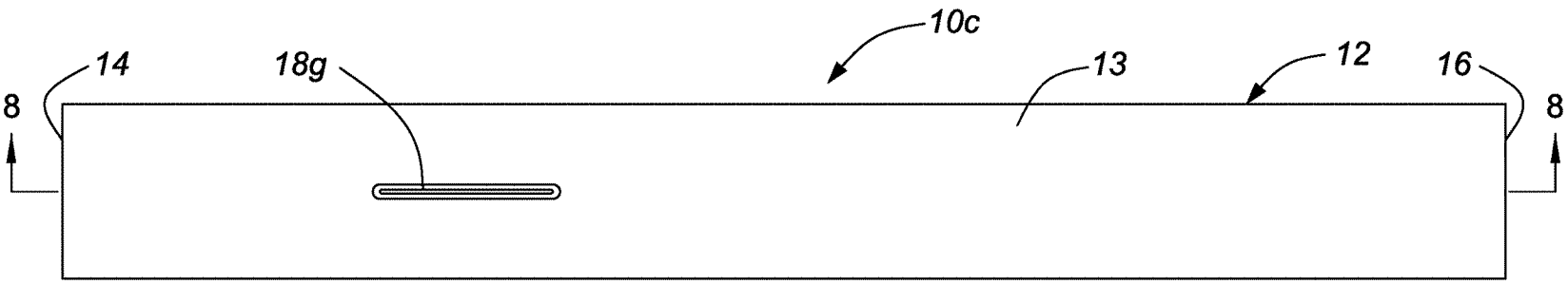
FIG. 7 is a side elevational view of yet another embodiment of a mechanically perforated well casing collar in accordance with the invention.

FIG. 7 is a side elevational view of yet another embodiment 10*c* of a mechanically perforated well casing collar in accordance with the invention. The well casing collar 10*c* is identical to the well casing collar 10*a* described above with reference to FIGS. 1-3, except that machined away areas 18*g*-18*h*, 18*i*-18*j* and 18*k*-181 (see FIG. 9) are respectively machined in both the outer surface 13 of the casing collar 10*c* and within the guide and lock structure 22 of the casing collar 10*c*. A depth of respective ones of the pairs of the machined-away areas 18*g*-18*h*, 18*i*-18*j* and 18*k*-181 is a matter of design choice, provided that the thickness "T" meets the minimum yield strength criteria defined above. In this embodiment, the shape of each machined-away area pair 18*g*-18*h*, 18*i*-18*j* and 18*k*-181 is identical. This is also a matter of design choice, however.

Figure 8:
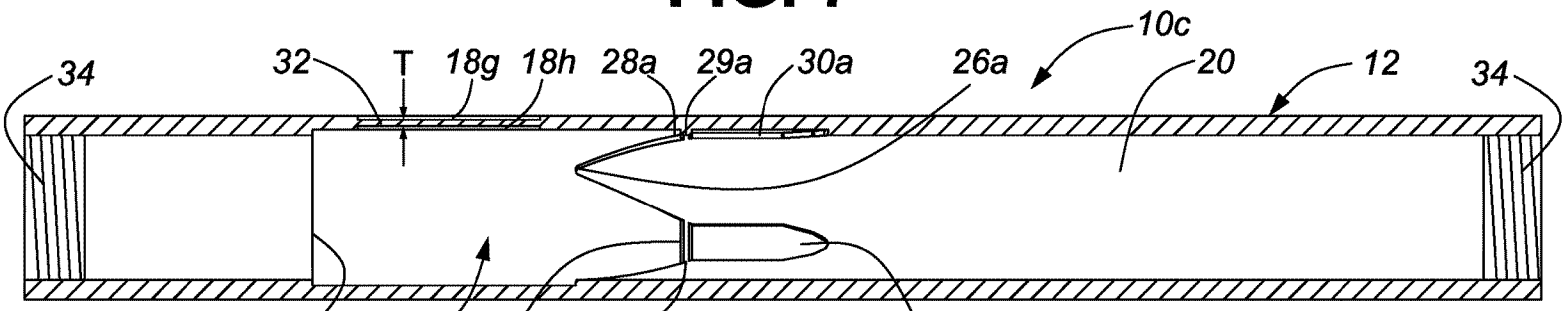
FIG. 8 is a cross-sectional view taken along lines 8-8 of the mechanically perforated well casing collar shown in FIG. 7.
Figure 9:
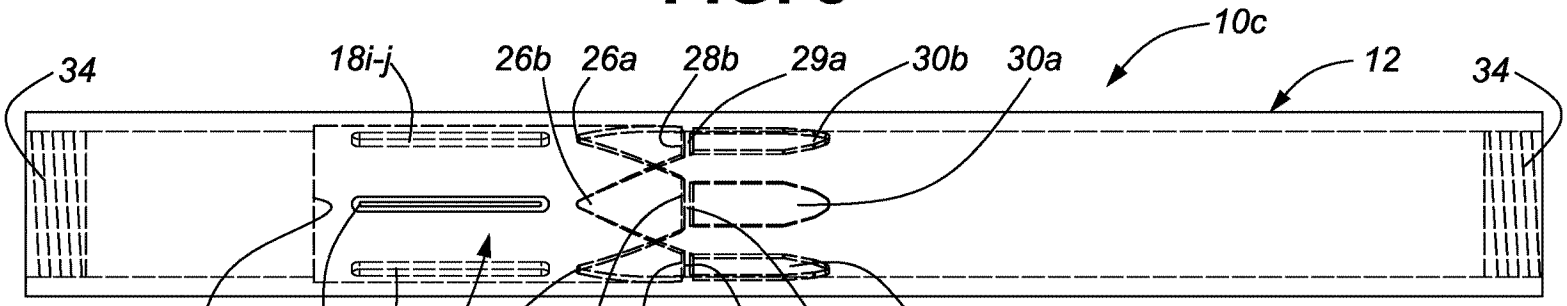
FIG. 9 is an x-ray view of the mechanically perforated well casing collar shown in FIG. 7.

FIG. 8 is a cross-sectional view taken along lines 8-8 of the mechanically perforated well casing collar 10*c* shown in FIG. 7, and FIG. 9 is an x-ray view of the mechanically perforated well casing collar 10*c* shown in FIG. 7. The remaining structure of the casing collar 10*c* described above with reference to FIGS. 1-3 will not be repeated.

Figure 10:
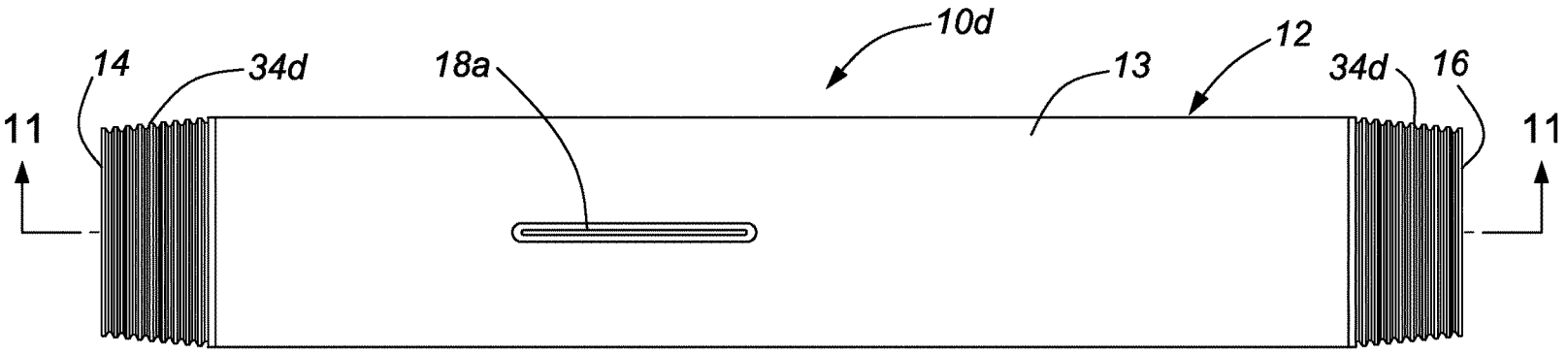
FIG. 10 is a side elevational view of yet a further embodiment of a mechanically perforated well casing collar in accordance with the invention.

FIG. 10 is a side elevational view of yet a further embodiment of a mechanically perforated well casing collar 10*d* in accordance with the invention. The well casing collar 10*d* is substantially identical to the well casing collar 10*a* described above with reference to FIGS. 1-3, and only the differences with be explained. In this embodiment, the uphole end 14 and the downhole end 16 have a respective pin thread 34*d*, though each end can also be box threaded as shown in FIG. 1 as a matter of design choice dependent on the plain casing joints used to assemble a casing string. Although casing collars are generally box threaded, pin threaded collars are commercially available. Any other feature of the casing collars in accordance with this invention is independent of the tread type on the uphole end 14 and/or the downhole end 16 of those casing collars. In addition, the guide and lock structure 22*d* of the casing collar 10*d* is designed to permit a mechanical perforator with guide skates to more readily "skip" through the casing collar as it is pulled uphole, as will be explained below in more detail with reference to FIGS. 16-18. Consequently, a guide recess uphole edge 24*d* (see FIGS. 11 and 12) of the guide and lock structure 22*d* is machined to incline outwardly from the inner surface 20 at an angle of about 20°. Likewise, the bottoms of guide funnels 28*d*, 28*e* and 28*f* are machined to respectively include guide funnel end ramps 29*d*, 29*e* and 29*f* that are respectively outwardly inclined from the inner surface 20 at a first angle of about 45° for about one-half of a depth of the guide structure 22*d* and a second angle of about 20° thereafter. Likewise, skate lock recesses 30*d*, 30*e* and 30*f* have respective uphole end ramps 31*a*, 31*b* and 31*c* that are respectively outwardly inclined from the inner surface 20 at a first angle of about 45° for about one-half of a depth of the guide structure 22*d* and a second angle of about 20° thereafter.

Figure 11:
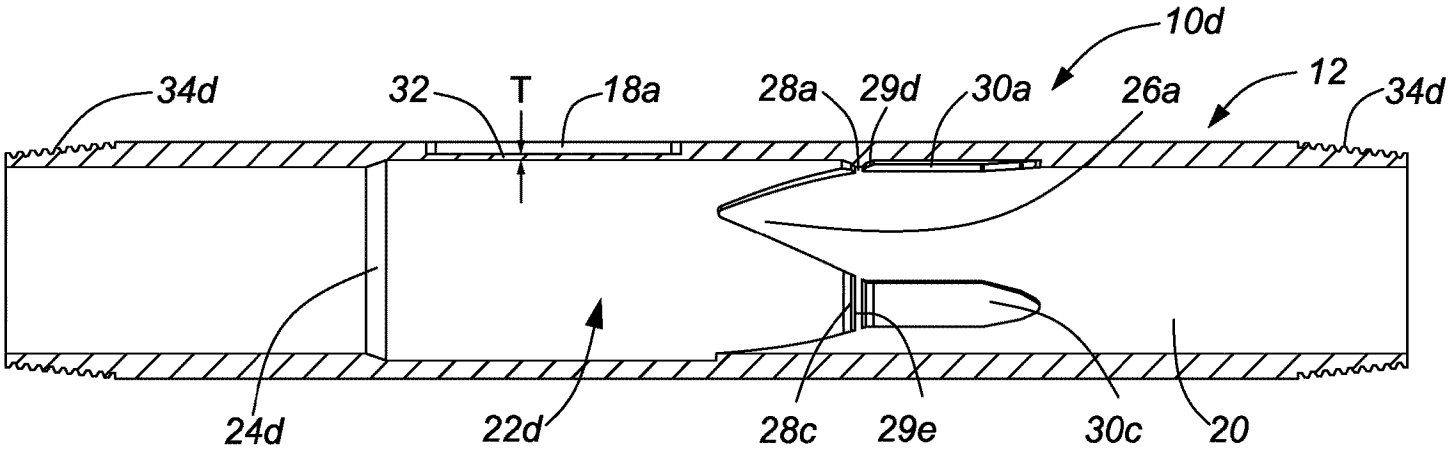
FIG. 11 is a cross-sectional view taken along lines 11-11 of the mechanically perforated well casing collar shown in FIG. 10.
Figure 12:
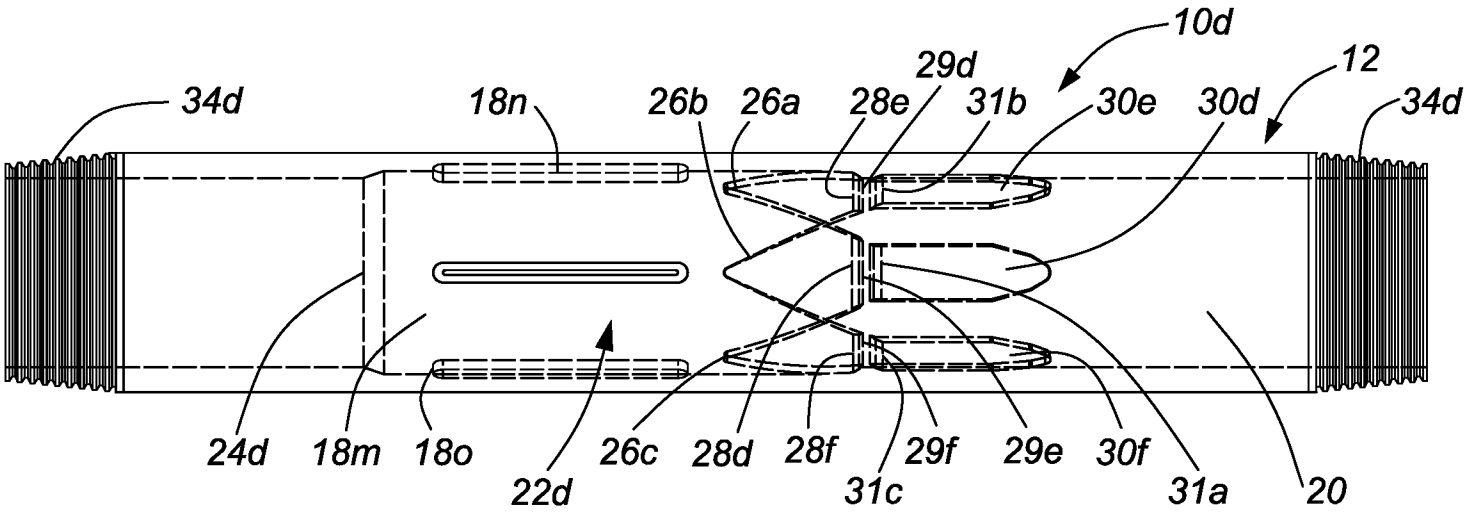
FIG. 12 is an x-ray view of the mechanically perforated well casing collar shown in FIG. 10.

FIG. 11 is a cross-sectional view taken along lines 11-11 of the mechanically perforated well casing collar 10*d* shown in FIG. 10, and FIG. 12 is an x-ray view of the mechanically perforated well casing collar 10*c* shown in FIG. 7. The remaining structure of the casing collar 10*d* described above with reference to FIGS. 1-3 will not be repeated.

Figure 13:
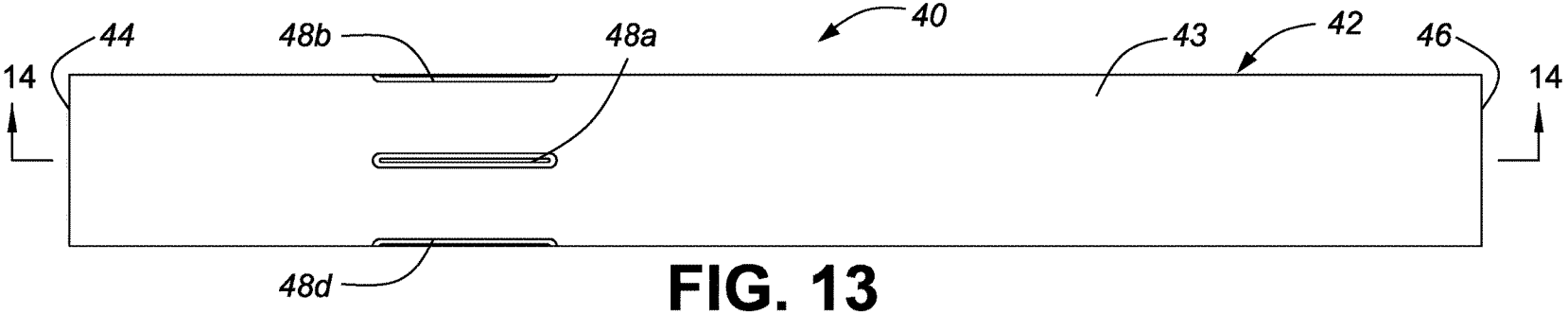
FIG. 13 is a side elevational view of another embodiment of a mechanically perforated well casing collar in accordance with the invention.

FIG. 13 is a side elevational view of yet another embodiment of a mechanically perforated well casing collar 40 in accordance with the invention. The casing collar 40 has a sidewall 42 with an outer surface 43 and an inner surface 50 (see FIG. 14), an uphole end 44 and a downhole end 46. In this embodiment, the outer surface 43 is provided with four machined-away areas 48*a*-48*d* to facilitate mechanical perforation of the casing collar 40 and reduce distortion of the sidewall 42 when the casing collar 40 is mechanically perforated. A size and shape of the machined-away areas 48*a*-48*d* is a matter of design choice, within constraints well understood by those skilled in the art of casing perforation. In this embodiment the machined-away areas 48*a*-48*d* are straight slots, which are efficiently machined as described above with reference to FIG. 1. It should be understood that the machined-away areas 48*a*-48*d* may be machined-away on the outer surface 43 of the sidewall 42, as shown, on the inner surface 50 in a manner described above with reference to FIGS. 4-6, or on both the inner surface 50 and the outer surface 43, in a manner described above with reference to FIGS. 7-9.

Figure 14:
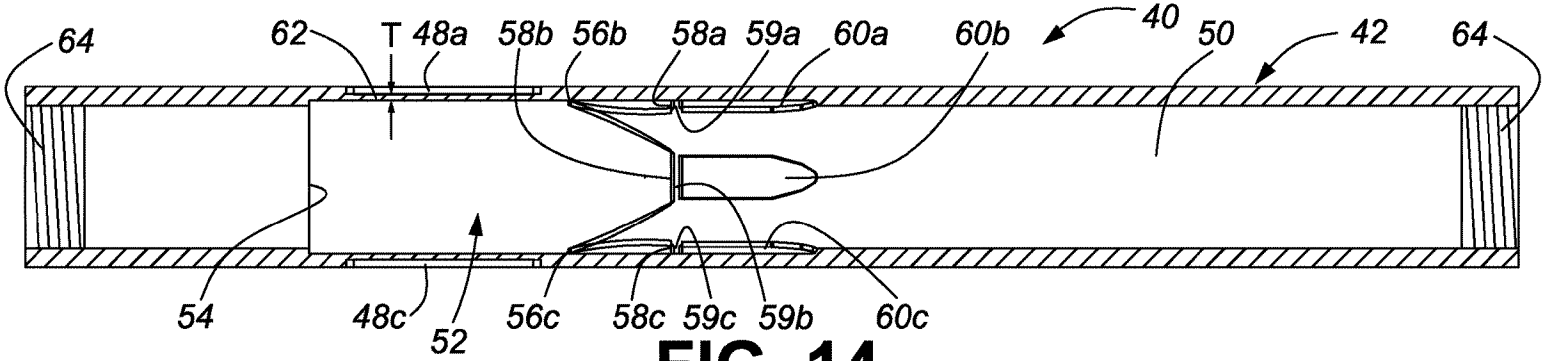
FIG. 14 is a cross-sectional view taken along lines 14-14 of the mechanically perforated well casing collar shown in FIG. 13.

FIG. 14 is a cross-sectional view taken along lines 14-14 of the mechanically perforated well casing collar 40 shown in FIG. 13. As explained above with reference to FIG. 2, the machined-away areas 48*a*-48*d* are respectively cut to a consistent depth, leaving sidewall material 62 at each machined-away area having the thickness "T". As also explained above, the thickness "T" is dependent on a metallurgy of the casing collar 40, and a planned maximum fluid pressure to be used during the hydraulic fracturing operations used to complete the well. As also explained above, the thickness "T" of remaining sidewall material 62 must have a yield strength that exceeds the planned maximum hydraulic fracturing fluid pressure to be used to complete the well, which permits fracturing fluid to be pumped down an annulus of the casing string without hydraulically rupturing any of the machined-away areas before they are mechanically perforated.

Figure 15:
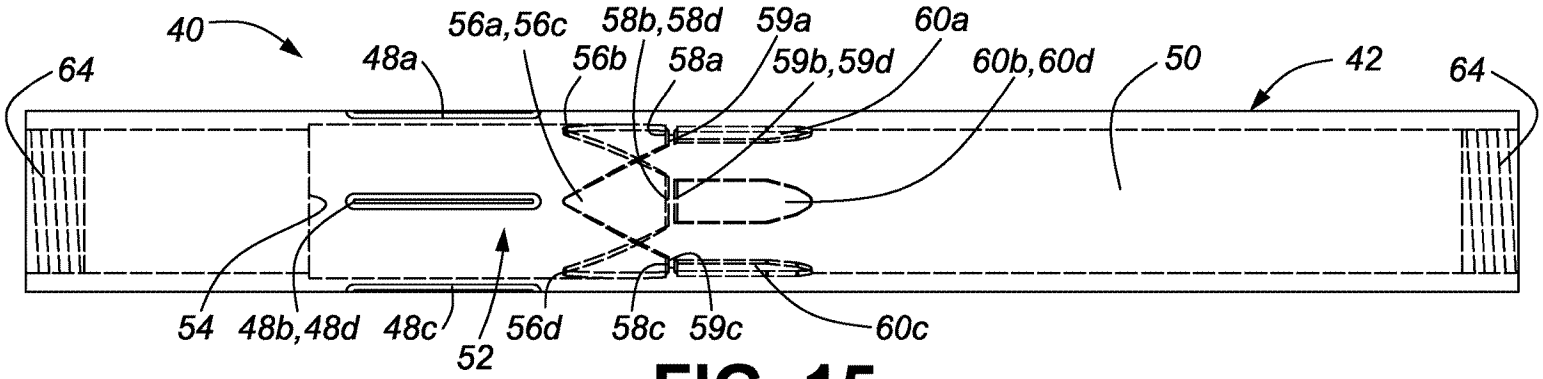
FIG. 15 is an x-ray view of the mechanically perforated well casing collar shown in FIG. 13.

FIG. 15 is an x-ray view of the mechanically perforated well casing collar 40 shown in FIG. 13. As explained above, the well casing collar 40 is configured for a mechanical perforating tool having four guide "skates" and four perforating blades. In this embodiment a guide and lock structure 52 has a guide recess upper edge 54 and includes four guide points 56*a*, 56*b*, 56*c* and 56*d*, which, as required, respectively deflect four guide skates of the mechanical perforator into respective guide funnels 58*a*, 58*b*, 58*c* and 58*d* as the mechanical perforator is pushed into the casing string. As the mechanical perforator is pushed further into the casing string, the respective guide skates are guided along a side of the respective guide funnels 58*a*, 58*b*, 58*c* and 58*d* to a bottom of each guide funnel 58*a*-58*d* and are urged out of the bottom of each guide funnel 58*a*-58*d* by respective guide funnel end ramps 59*a*, 59*b*, 59*c* and 59*d*. The respective guide skates are aligned with respective skate lock recesses 60*a*, 60*b*, 60*c* or 60*d* and respectively drop into the one of the skate lock recesses 60*a*-60*d*, which have square-stepped downhole ends to resist further movement of the mechanical perforator, locking perforator blades in alignment with the respective machined-away areas 48*a*, 48*b*, 48*c* and 48*d*. Box threads 64 on each end of the casing collar 40 permit the connection of respective plain casing joints (not shown) having mating pin threads, in a manner well understood in the art.

The embodiments of the casing collars 10*a*, 10*b*, 10*c*, 10*d* and 40 described above may be gas nitrided or salt bath nitrided to inhibit corrosion. Prior to nitriding, the threaded ends 34, 34*d*, 64 may be masked to prevent over-hardening of the threads. Alternatively, the entire outer surfaces 13 shown in FIGS. 1, 4, 7 and 10, or outer surface 43 shown in FIG. 13, may be wrapped in a protective swellable wrap that is commercially available for protecting exposed pipe surfaces during storage, casing string assembly, casing string insertion into a wellbore, and subsequent cementing operations.

Figure 16:
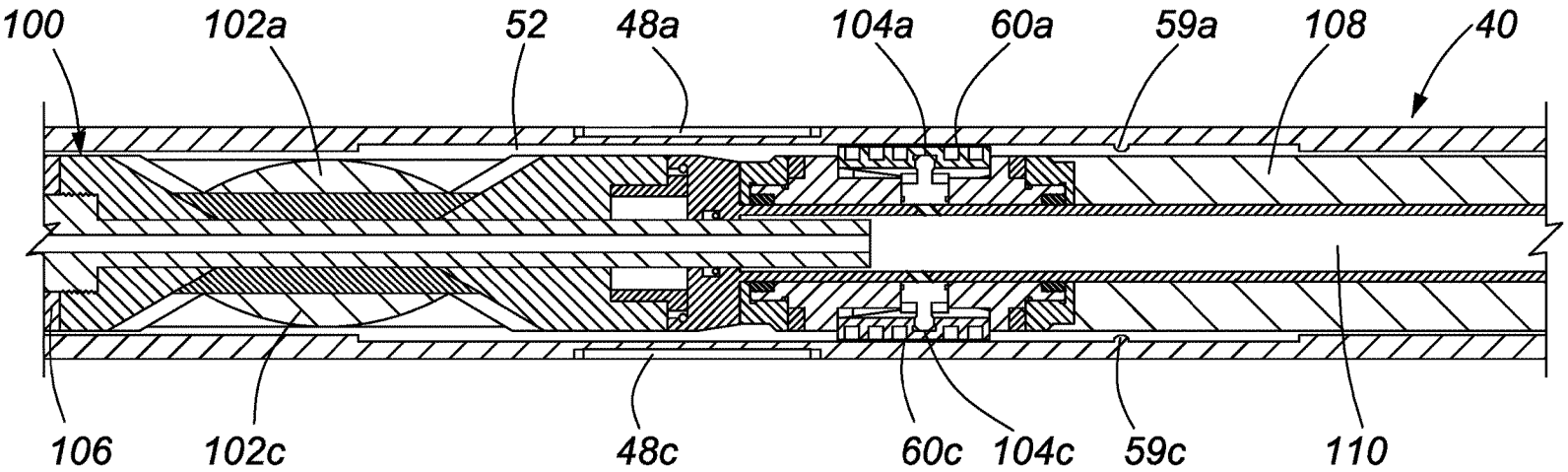
FIG. 16 is a cross-sectional view of an exemplary mechanical perforator being run into a casing collar in accordance with the invention.

FIG. 16 is a cross-sectional view of the exemplary mechanical perforator 100 being pushed into a casing collar 40 described above with reference to FIGS. 10-12. The mechanical perforator 100 is described in detail in Applicant's concurrently-filed United States patent application entitled "Mechanical Perforator with Guide Skates", the specification of which is incorporated herein by reference.

In this exemplary embodiment, the mechanical perforator 100 has 4 perforator blades (only two, 102*a* and 102*c* can be seen in cross-section) and four guide skates (only two, 104*a* and 104*c* can be seen in cross-section). A linear force generator 106 generates mechanical force to operate the respective perforator blades. The linear force generator 106 may be, for example, one of the force multipliers described in Applicant's two patent applications, the specifications of which are respectively incorporated herein by reference, namely: U.S. patent application Ser. No. 16/004,771 filed May 11, 2018 entitled "Modular Force Multiplier For Downhole Tools"; and U.S. patent application Ser. No. 15/980,992 filed May 16, 2018 and also entitled "Modular Force Multiplier For Downhole Tools". Downhole tool termination components 108 serve pumped fluid control functions described in Applicant's above-referenced co-pending patent application entitled "Mechanical Perforator with Guide Skates".

Fluid pumped into a central passage 110 of the mechanical perforator 100 controls a disposition of the guide skates 104*a* and 104*c*, which are normally urged to a retracted position by coil springs (not shown), In an exemplary use of the mechanical perforator 100, it is connected to a coil tubing or jointed tubing work string (not shown) and run to a bottom of a cased well bore using the work string without fluid pressure in the central passage 110, so the guide skates 104*a*, 104*c* are in the retracted position and the mechanical perforator 100 can be pushed down the cased well bore without resistance. When the bottom of the cased well bore is reached, fluid is pumped through the work string and into the central passage 110. Initially, the fluid pressure in the central passage is raised to about 200-300 psi, and the work string is pulled up from the bottom of the cased well bore until a weight indicator connected to the work string indicates positive spikes as the guide skates 104*a*, 104*c* "skip" through a guide and lock structure of a casing collar 40 nearest the bottom of the cased well bore. When the casing collar 40 is thus detected, the fluid pressure in the central passage is increased to about 2,000 psi, for example, and the work string is slowly pushed back down the well bore. The weight indicator will register a pronounced negative spike as the guide skates are urged out of the respective guide funnels 58*a*-58*d* (see FIG. 15), indicating that the mechanical perforator 100 is about to lock in an operative position as the guide skates 104*a*, 104*c* drop into the skate lock recesses 60*a*-60*d* (see FIG. 15). As soon as the weight indicator registers another pronounced negative spike, the tubing sting is halted with the guide skates 104*a*, 104*c* locked in the respective skate lock recesses 60*a*, 60*c*.

Figure 17:
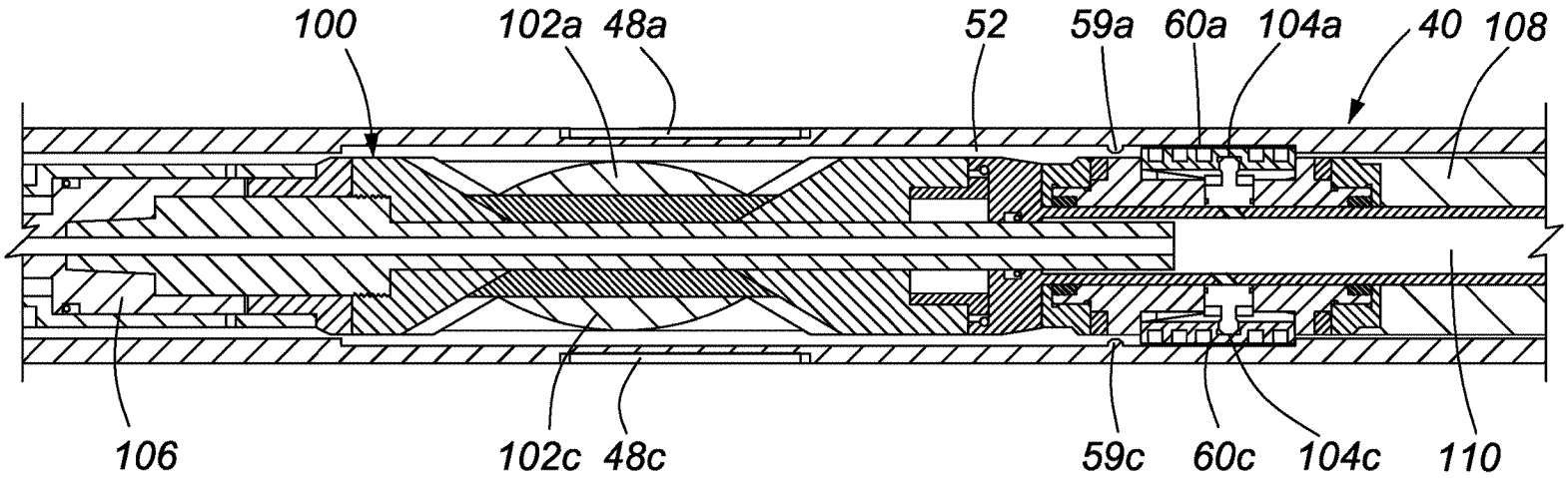
FIG. 17 is a cross-sectional view of the exemplary mechanical perforator locked in place for the perforation of the casing collar shown in FIG. 16.

FIG. 17 is a cross-sectional view of the mechanical perforator 100 shown in FIG. 16, locked in the casing collar 40 in a position for perforating the casing collar 40. After the guide skates 104*a*, 104*c* are locked in the casing collar 40, the force generator 106 can be operated to drive the respective perforator blades 102*a*, 102*c* through the machined-away areas 48*a*, 48*c* of the casing collar 40 and the casing collar 40 will be perforated in 4 radially spaced-apart locations (only two are shown) without significantly distorting the internal diameter of the casing collar 40. The mechanical perforator 100 can then be moved downhole and fracturing fluid pumped down an annulus of the cased well bore and through the newly formed perforations in the casing collar. A complete description of that process is beyond the scope of this disclosure, but is described in detail in Applicant's co-pending United States patent application entitled "Method of Casing and Completing a Hydrocarbon Well Bore Using Mechanically Perforated Casing Collars", the specification of which is incorporated herein by reference.

Figure 18:
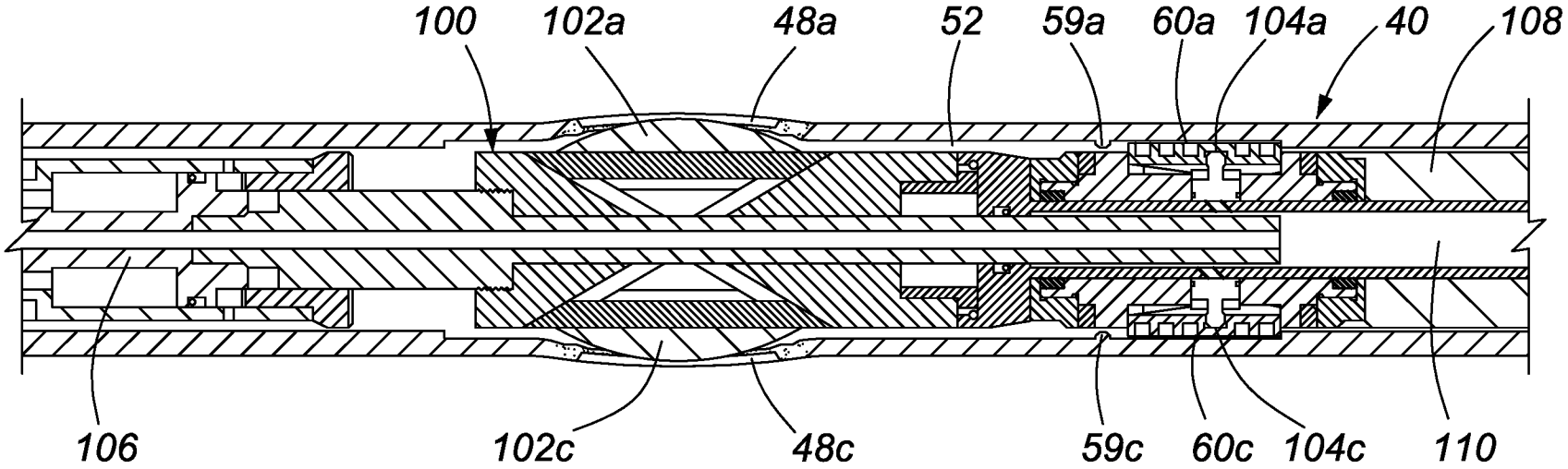
FIG. 18 is a cross-sectional view of the exemplary mechanical perforator shown in FIG. 17 after it has perforated the casing collar.

FIG. 18 is a cross-sectional view of the mechanical perforator 100 shown in FIG. 17, after the casing collar 40 has been perforated, and prior to retracting the perforator blades 102*a*, 102*c*. As shown schematically, the machined-away areas 48*a*, 48*c* yield to pressure of the respective perforator blades 102*a* and 102*c*, leaving perforations through which fracturing fluid can pass after the perforator blades 102*a* and 102*c* are withdrawn and the mechanical perforator 100 is moved downhole. As explained above, weakening of the casing collar 40 at the machined-away areas 48*a*, 48*c* facilitates perforation without undue distortion of the sidewall 42 of the casing collar 40, facilitating subsequent remedial work in the well bore, if required.

The embodiments of the casing collars 10*a*, 10*b*, 10*c*, 10*d* and 40 described above have been shown and described having a guide and lock structure, 22, 52 with a guide point, a guide funnel and a skate lock recess for each machined-away area of the casing collar. As will be understood by those skilled in the art, this is a matter of design choice. The mechanical perforator 100 may be designed to use a guide and lock structure having a different number of guide skates than the number of perforator blades, as will be readily understood by those of ordinary skill in the art.

The explicit embodiments of the invention described above have been presented by way of describing casing collars only. It should be understood that the invention may also be practiced using heavy-weight casing joints that are combined with plain casing joints and plain casing collars to assemble a well casing string, in a manner that will be readily understood by persons of ordinary skill in the art. The scope of the invention is therefore not limited solely to casing collars, per se, and the term "casing collar" as used in above and in the append claims is intended to mean any pipe used in a casing string to case a well bore.

We claim:

1. A mechanically perforated well casing collar comprising a tubular pipe having a sidewall with at least one machined-away area that facilitates mechanical perforation of the sidewall, the sidewall further having an inner surface with a guide and lock structure that comprises a recessed annular step in the inner surface of the sidewall, at least two guide points adapted to deflect a mechanical perforator and a guide funnel associated with each of the at least two guide points, the guide structure being adapted to guide a mechanical perforator into a position in which at least one perforator blade of the mechanical perforator is aligned with respective ones of the at least one machined-away area and the lock structure is adapted to permit the mechanical perforator to lock in said position.

2. The mechanically perforated well casing collar as claimed in claim 1 wherein the at least one machined-away area that facilitates mechanical perforation of the sidewall comprises one of: a machined-away area in an outer surface of the sidewall; a machined-away area in the inner surface of the sidewall; and, a machined-away area on both the outer and the inner surfaces of the sidewall.

3. The mechanically perforated well casing collar as claimed in claim 2 comprising at least three machined-away areas that respectively facilitate mechanical perforation of the sidewall.

4. The mechanically perforated well casing collar as claimed in claim 1 wherein the guide and lock structure further comprises a lock recess aligned with a bottom end of each guide funnel.

5. The mechanically perforated well casing collar as claimed in claim 4 wherein each skate lock recess has a square-stepped downhole end.

6. A mechanically perforated well casing collar comprising a tubular body having a sidewall with at least three spaced-apart machined-away areas that respectively facilitate mechanical perforation of the sidewall, and an inner surface with a guide structure comprising recesses on an inner surface of the sidewall adapted to guide a mechanical perforator having at least three perforator blades into a position in which the at least three perforator blades are respectively in alignment with respective ones of the machined-away areas, and further provides a lock structure adapted to lock the mechanical perforator in said position.

7. The mechanically perforated well casing collar as claimed in claim 6 wherein the three machined-away areas comprise any one of: machined-away areas in an outer surface of the sidewall; machined-away areas in the inner surface of the sidewall; and, machined-away areas in both the inner surface and the outer surface of the sidewall.

8. The mechanically perforated well casing collar as claimed in claim 6 wherein guide structure comprises an annular step in the inner surface of the sidewall.

9. The mechanically perforated well casing collar as claimed in claim 6 wherein the guide structure further comprises a guide point associated with each of the at least three machined away areas that facilitate mechanical perforation of the sidewall.

10. The mechanically perforated well casing collar as claimed in claim 6 wherein the guide structure further comprises a guide funnel associated with each guide point.

11. The mechanically perforated well casing collar as claimed in claim 6 wherein the lock structure comprises a lock recess associated with each of the at least three machined-away areas that facilitate mechanical perforation of the sidewall.

12. The mechanically perforated well casing collar as claimed in claim 11 wherein each lock recess has a square-stepped downhole end.

13. A mechanically perforated well casing collar comprising a sidewall with an inner surface having a guide structure adapted to guide a mechanical perforator having a perforator blade into a position within the well casing collar in which the perforator blade is aligned with a machined-away area on the sidewall that facilitates mechanical perforation of the sidewall, sidewall material at the machined-away area having a predetermined yield strength, the guide structure comprising a recessed annular step in the sidewall and a guide point that deflects the mechanical perforator into a guide funnel that urges the mechanical perforator into a lock recess.

14. The mechanically perforated well casing collar as claimed in claim 13 wherein the machined-away area comprises one of: a machined away area on an outer surface of the sidewall; a machined-away area on an inner surface of the sidewall; and, machined away areas on both the outer and the inner surfaces of the sidewall.

15. The mechanically perforated well casing collar as claimed in claim 13 wherein the lock recess is adapted to lock the mechanical perforator in said position.

* * * * *